US006550076B1

(12) United States Patent
Fish

(10) Patent No.: US 6,550,076 B1
(45) Date of Patent: Apr. 22, 2003

(54) VALVE ASSEMBLY FOR A PRESSURE FLUSH SYSTEM

(75) Inventor: Robert H. Fish, Howell, MI (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 09/967,012

(22) Filed: Sep. 28, 2001

(51) Int. Cl.[7] ..... E03D 1/22
(52) U.S. Cl. ..... 4/359; 4/362; 4/354
(58) Field of Search ..... 4/362, 359, 354

(56) References Cited

U.S. PATENT DOCUMENTS

| | | | | | |
|---|---|---|---|---|---|
| 1,636,402 | A | * | 7/1927 | Welcker | 367/95 |
| 3,677,294 | A | * | 7/1972 | Gibbs et al. | 137/572 |
| 3,817,286 | A | | 6/1974 | Caron et al. | |
| 3,817,489 | A | * | 6/1974 | Caron et al. | 251/38 |
| 4,183,108 | A | | 1/1980 | Hamilton | |
| 4,233,698 | A | | 11/1980 | Martin | |
| 4,955,921 | A | | 9/1990 | Basile et al. | |
| 4,984,311 | A | | 1/1991 | Basile et al. | |
| 5,005,226 | A | | 4/1991 | Basile et al. | |
| 5,027,444 | A | | 7/1991 | Tsals | |
| 5,046,201 | A | | 9/1991 | Steinhardt et al. | |
| 5,136,732 | A | | 8/1992 | Andersson | |
| 5,241,711 | A | | 9/1993 | Badders | |
| 5,361,426 | A | | 11/1994 | Martin | |
| 5,435,019 | A | | 7/1995 | Badders | |
| 5,553,333 | A | | 9/1996 | Andersson | |
| 5,652,969 | A | | 8/1997 | Taylor | |
| 5,797,582 | A | | 8/1998 | Simoens | |
| 5,802,628 | A | | 9/1998 | Spoeth et al. | |
| 5,970,527 | A | | 10/1999 | Martin et al. | |

* cited by examiner

*Primary Examiner*—Gregory L. Huson
*Assistant Examiner*—Huyen Le
(74) *Attorney, Agent, or Firm*—Cook, Alex, McFarron, Manzo, Cummings & Mehler, Ltd.

(57) ABSTRACT

A pressure flush system for use within a toilet tank includes a pressure flush tank having an inlet port and a discharge port, an air inlet, and a valve assembly. The valve assembly includes a generally cylindrical housing, a water inlet in fluid communication with the pressure flush tank, a water outlet in fluid communication with the discharge port, a normally closed valve which allows fluid communication between the water inlet and water outlet when the valve is opened, a piston axially spaced from the valve, and a flexible tube positioned within the housing which is carried between the valve and the piston and in fluid communication therebetween. Relative to the valve, the piston is movable into and out sealing engagement with the discharge port to permit the discharge of water under pressure contained within the pressure flush tank. The flexible tube is movable in response to movement of the piston.

21 Claims, 4 Drawing Sheets

10
12
14
16
16
18
18
20
22
24
26
28
30
32
34
36

VALVE ASSEMBLY FOR A PRESSURE FLUSH SYSTEM

FIELD OF THE INVENTION

This invention relates to pressure flush tanks or pressure flush systems of the type disclosed in U.S. Pat. Nos. 4,233,698 and 5,802,628, owned by the assignee of the present application, Sloan Valve Company of Franklin Park, Ill., and incorporated by reference herein. In particular, the invention relates to an improved valve assembly for such a pressure flush tank having a valve and a piston which are hydrodynamically connected. The invention further provides a valve assembly with a flexible tube which is responsive to movement by the piston.

SUMMARY OF THE INVENTION

The present invention relates to pressure flush tanks and in particular to an improved valve assembly for such tanks.

A primary purpose of the invention is a pressure flush tank as described which includes a valve and a piston which are hydraulically connected so that piston movement results from a hydraulic response to movement of the valve.

Another purpose of the invention is to provide a valve assembly which, upon actuation of the valve, allows water contained within the valve assembly to flow through the valve and the piston to a discharge port and results in movement of the piston out of sealing engagement with the discharge port.

Another purpose of the invention is to provide a valve assembly with a flexible tube.

Another purpose of the invention is to provide a valve assembly with a flexible tube which is carried between the valve and the piston and which moves in response to movement of the piston.

Another purpose of the invention is to provide a valve assembly with inner and outer coaxial fluid passageways which permit the storage and outflow of water contained within the valve assembly.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
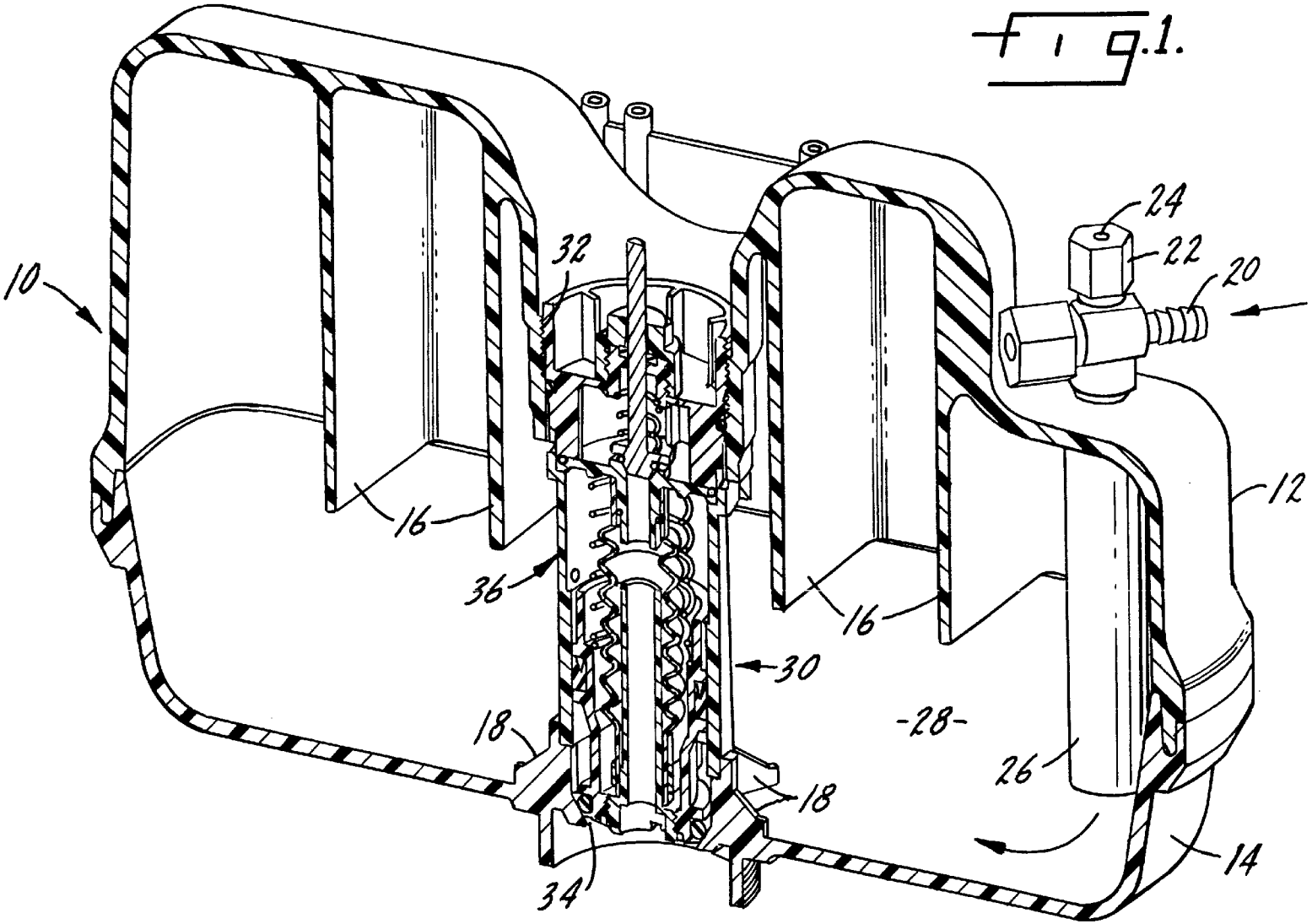
FIG. 1 is a section of the valve assembly positioned within a pressure flush tank.

FIG. 1 shows a pressure flush tank indicated generally at 10, which will be positioned within a toilet tank, not shown. The purpose of the pressure flush tank is to provide a measured quantity or volume of water under pressure so that the flushing system may be more effective, but yet use a volume of water consistent with current government regulations.

The tank 10 may include a top shell 12 and a bottom shell 14 which fit together to provide a watertight enclosure. The inside surface of the tank 10 may include a plurality of baffles 16 and fins 18. Water enters the tank 10 at an inlet port 20 which is connected to a suitable conduit and such conduit may also have a suitable shutoff valve connected thereto. Adjacent the inlet port 20 there is an air inducer housing 22 which includes an air inlet 24. As water passes through the inlet port 20, the flow of water will cause the air inlet 24 to open, thus allowing both air and water to enter the interior of the tank 10. The air and water mixture enters the tank 10 through the interior tube 26 and is held within the tank which defines a cavity 28. A valve assembly 30 is centrally located within the tank 10 and extends between an upper tank opening 32 and a discharge port 34 which is in fluid communication with the toilet tank (not shown). The discharge port 34 is generally shaped as a conical seat.

In FIGS. 1–4, the valve assembly 30 includes a housing, generally indicated at 36, with upper and lower portions 38 and 40, respectively, a valve, generally indicated at 42, a valve return spring 44, a bellows tube 46, a piston return spring 48, a piston 50, and a sleeve 52. The housing upper portion 38 is generally cylindrical in shape with a threaded external surface 31, a radial web 35 and an axial bore 37. The axial bore 37 includes an inwardly projecting shoulder 39 and a threaded portion 41 which is radially spaced from the upper tank opening 32. The housing lower portion 40 defines a hollow cylindrical shape including an internal surface 43 and a valve assembly water inlet 45 which allows fluid communication with the tank cavity 28.

Figure 2:
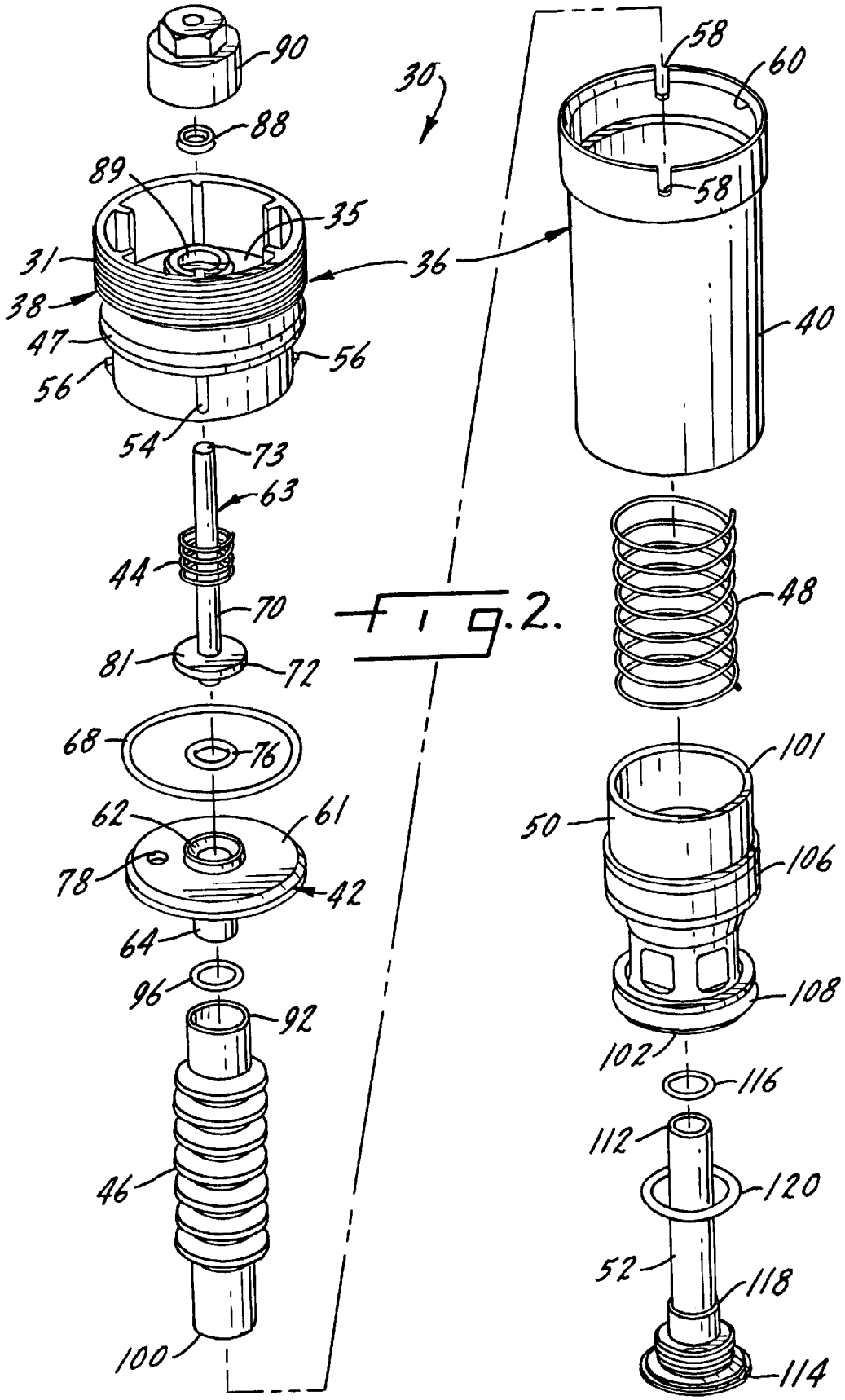
FIG. 2 is an exploded view of the valve assembly of the present invention.

As best seen in FIG. 2, the housing 36 is supported within the tank 10 at a top end by a threaded connection between the upper tank opening 32 and the housing upper portion 38. At the bottom end of the housing 36, the lower portion 40 is supported by the fins 18 which are radially disposed around the discharge port 34 and upwardly project into the tank cavity 28. The housing upper portion 38 matingly engages the lower portion 40 using a series of ribs 54 and tabs 56. The ribs 54 are received within corresponding grooves 58 on the housing lower portion and the tabs 56 engage the underside of a projecting annular rib 60 located on the internal surface of the housing lower portion. On the external surface of the housing upper portion 38, a seal 47 disposed within a groove 49 of the housing upper portion 38 seals the valve assembly 30 to the atmosphere.

The valve 42 is positioned within the housing 36 and includes a valve base 61, a valve seat 62, a valve actuator 63, and a downwardly projecting annular skirt 64 for directing water under pressure when the valve is opened. The valve base 61 forms a sealed partition, along with an annular valve seal 68, between the housing upper and lower portions 38 and 40. The valve actuator 63 has a stem 70, a head 72 and a distal end 73. The head 72, which is generally conical or frusto-conical in shape, includes an annular groove 74 which receives an O-ring seal 76 and is normally biased adjacent the valve seat 62 by the valve return spring 44. Projecting upwards from the head 72, the stem 70 extends through the axial bore 37 of the housing upper portion 38 and radial movement of the stem is limited by the inwardly projecting shoulder 39. Radially positioned from the valve seat 62, the valve base 61 defines a water passage 78 which allows fluid communication between the housing upper portion 38 and the housing lower portion 40, as will be described in further detail below.

The valve return spring 44 is circumferentially positioned around the valve actuator stem 70 and is disposed within a water cavity 86 defined by the housing upper portion 38. The valve return spring 44 biases the valve actuator head 72 against the valve seat 62 defining a closed valve position.

One end of the valve return spring 44 contacts an upwardly facing surface 81 of the valve actuator head 72 while the other end of the return spring is biased against an annular shoulder 82 of the housing upper portion 38. The end of the valve return spring 44 adjacent the annular shoulder 82 is restrained from radial movement by an annular projection 84. At the top of the housing 36, a seal 88, which is received within a groove 89, is circumferentially disposed around the valve actuator stem 70. The seal is secured by a center shaft nut 90 which is screwed onto the threaded portion 41 of the axial bore 37.

Figure 3:
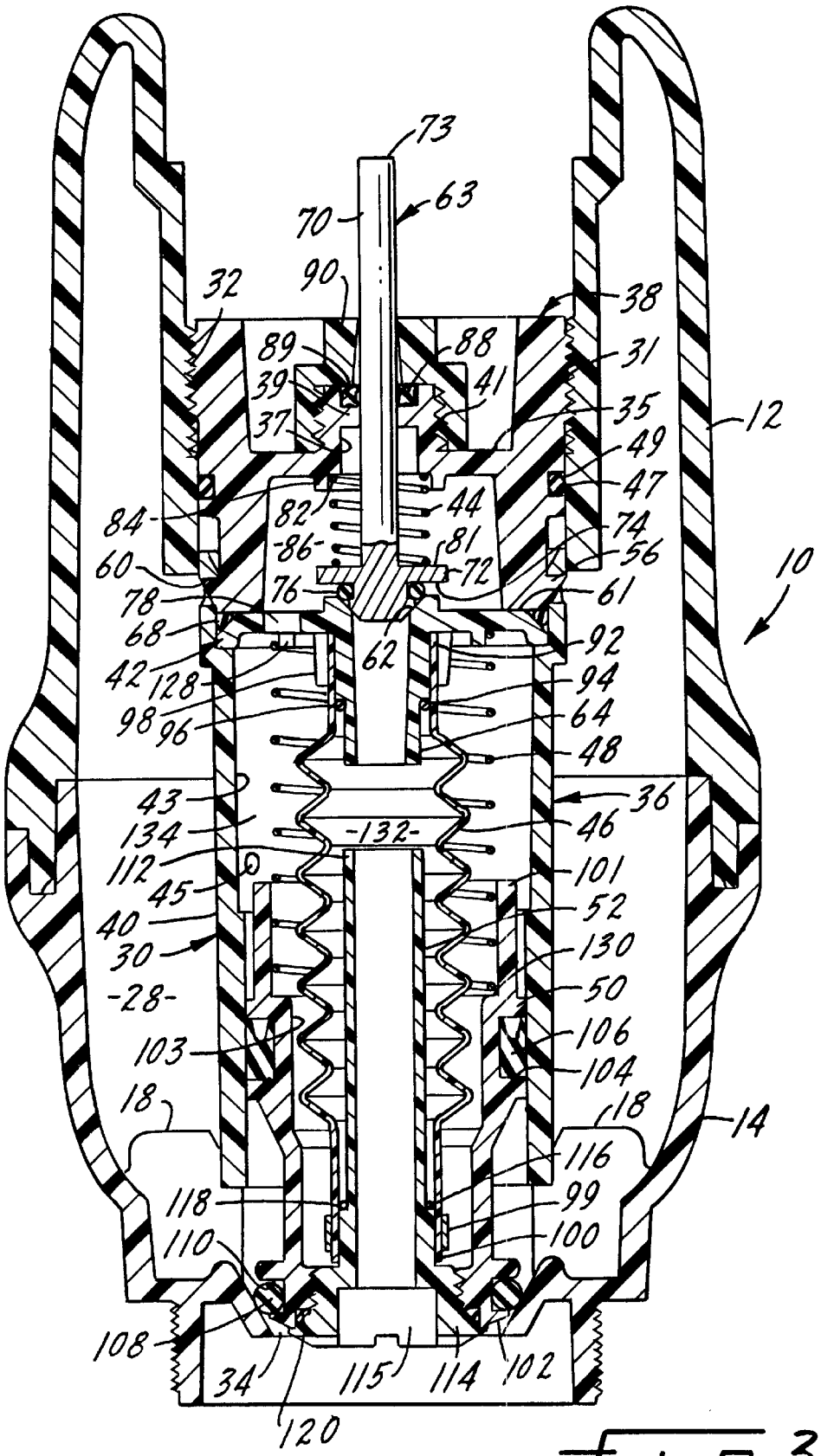
FIG. 3 is a section of the valve assembly in a fully closed position.
Figure 4:
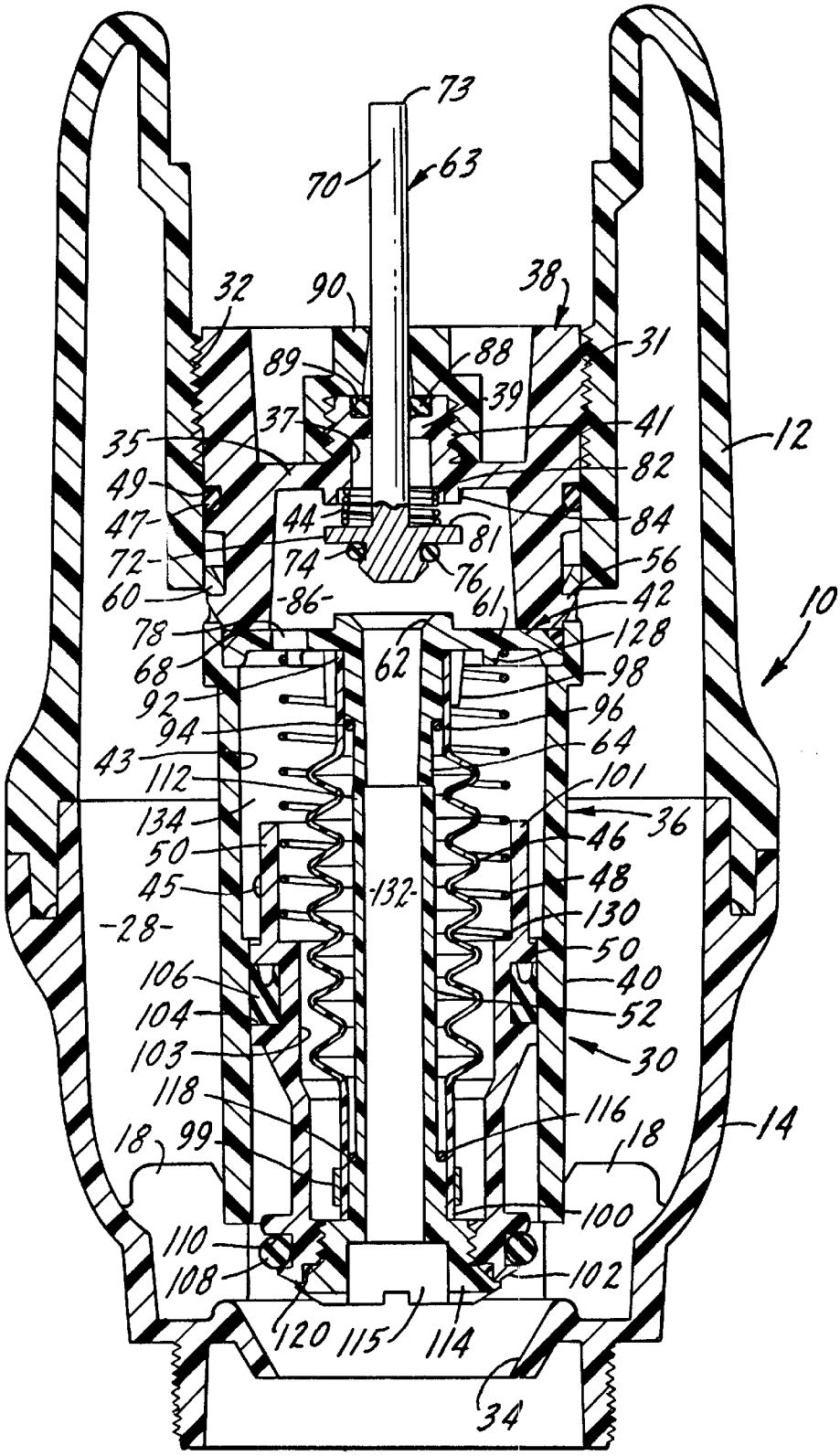
FIG. 4 is a section of the valve assembly in a fully opened position.

Turning to the housing lower portion 40, the bellows tube 46 is axially disposed within the housing and is carried either directly or indirectly between the valve and the piston. The bellows tube 46 is in fluid communication with the valve 42. As shown in FIGS. 3 and 4, the bellows tube 46 includes an upper end 92 which is radially disposed around the valve annular skirt 64. The annular skirt 64 also has a downwardly facing shoulder 94 which receives an O-ring seal 96 so as to fluidly seal the bellows tube 46 to the annular skirt. The valve 42 includes downwardly directed projections 98 which are radially spaced from the annular skirt 64 so as to position the bellows tube upper end 92 of the bellows tube 46 between the annular skirt 64 and the projections 98. The bellows tube 46 extends axially within the housing lower portion 40 from the upper end 92 to a lower end 100 and the tube preferably has an undulating shape, as illustrated. The bellows tube lower end 100 is secured by a clamp or seal 99 to the sleeve 52.

The piston 50 is circumferentially positioned around the bellows tube 46. The piston 50 extends from an upper end 101 positioned within the housing 36 to a lower end 102 outside thereof. The piston generally has a hollow cylindrical, pseudo-concave shape with an axial bore therethrough 103. The axial bore 103 receives at least one axially disposed fluid conduit therein such as the bellows tube 46 and the sleeve 52 so that water contained within the housing is discharged axially through said piston. There is an annular groove 104 on the piston exterior surface which receives a U-ring seal 106 to form a fluid seal between the piston and the internal surface 43 of the housing lower portion 40. Above the U-ring seal 106, the piston upper end 101 is spaced from the internal surface 43. Before actuation of the valve 42, the piston lower end 102 extends beyond the housing 36 and is positioned within the discharge port 34 to prevent the discharge of water when the valve is in the closed position. At the discharge port 34, a fluid seal is effectuated by an O-ring seal 108 which is positioned within an annular groove 110 of the piston lower end 102. The piston 50 is positioned around the bellows tube 46 and radially spaced therefrom so as to allow the return spring 48 to be positioned therebetween. The piston 50is in fluid communication with the bellows tube 46.

The sleeve 52 includes an upper end 112 positioned within the bellows tube 46 and a lower end 114 positioned outside of the bellows tube. In addition, the sleeve 52 is axially positioned within the piston axial bore 103. The sleeve upper end 112 is axially spaced from the bellows tube upper end 92 and the valve annular skirt 64 when the valve is closed. The sleeve 52, which has a generally rigid and hollow, cylindrical shape, extends downwardly to the lower end 114, which is generally coextensive with the piston lower end 102 and which is in fluid communication with the discharge port 34. The sleeve lower end 114 defines a valve assembly water outlet 115 so as to permit water contained within valve assembly 30 to flow through the water outlet and through the discharge port 34 when the valve is opened. The bellows tube lower end 100 is in fluid communication with the sleeve 52 and sealingly engages the sleeve 52 with an O-ring seal 116 and the clamp 99. The seal 116 is received by an upwardly facing shoulder 118 of the sleeve 52. At the sleeve lower end 114, the piston 50 and the sleeve 52 are directly connected by a threadable engagement which allows the piston to be indirectly connected to the bellows tube 46. Thus, movement by the piston 50 causes corresponding movement by the bellows tube 46 and the sleeve 52.

Located between the bellows tube 46 and the piston 50, the piston return spring 48 has an upper end which is biased against the underside of the valve base 61 and which is fixed from radial movement by an annular rim 128 formed on the underside of the valve base 61. The lower end of the return spring 48 sits on an annular shoulder 130 formed in the axial bore 103 of the piston 50. Upon emptying of the tank, the return spring 48 biases the piston 50 into a closed position so that the piston lower end 102 extends beyond the housing 36 and is positioned within the discharge port 34. With the seal 108, the piston lower end 102 forms a fluid seal with the discharge port 34 to prevent the discharge of water contained within the tank 10 when the valve assembly 30 has not been actuated.

Turning back to the bellows tube 46, it is carried either directly or indirectly between the valve 42 and the piston 50 and provides fluid communication therebetween. Upon actuation of the valve 42, the bellows tube 46 is axially collapsible in response to axial movement of the piston 50. The bellows tube upper end 92 remains fixed during axial movement while the lower end 100 moves in response to axial movement of the piston 50. Accordingly, when the piston moves axially upward, the bellows tube lower end 100 moves upward while the upper end 92 remains fixed, thereby causing the bellows tube to collapse or retract along its axis. Conversely, as the piston moves axially downward, the bellows tube lower end 100 moves downward, thus causing axial expansion of the bellows tube 46. Instead of a bellow tube, it is possible to use any type of flexible tube or the like which is capable of movement in response to movement of the piston although it is preferred that the tube be capable of axial retraction and expansion in response to movement of the piston.

The bellows tube 46 further defines inner and outer coaxial fluid passageways 132 and 134, respectively, which are fluidly sealed therebetween by the valve 42 when the valve is closed. The inner passageway 132 is in fluid communication with the discharge port 34 and is defined by the internal surfaces of the bellows tube 46, the sleeve 52 and the valve annular skirt 64. The inner passageway 132 extends through the piston axial bore 103 such that, upon actuation of the valve, water contained within the housing is discharged axially through the piston. The outer passageway 134 is in fluid communication with the pressure flush tank 10 at the valve assembly water inlet 45 and contains water under pressure therefrom when the valve 42 is closed. As shown in FIGS. 3 and 4, the outer passageway 134 is circumferentially disposed around the bellows tube 46, which defines the internal boundary of the outer passageway 134, and is circumferentially bounded by the housing internal surface 43. Within the outer passageway, water is permitted to flow within the annular spaces defined between the bellow tube 46 and the piston axial bore 103 and between the piston 50 and the housing internal surface 43. Water is prevented from flowing downstream of the outer passageway 134 by the U-ring seal 106 and the O-ring seal 120. Water within the outer passageway 134 is in fluid communication with the water cavity 86 by the water passage 78 so that water is permitted to flow from the outer passageway 134 into the water cavity 86 as water flows into the valve assembly from the tank. The water contained within the outer passageway 134 together with the return spring 48 assists in biasing the piston 50 to a closed position. While the valve remains closed, the outer passageway 134 and the water cavity 86 receive and store water from the tank 10.

FIG. 4 shows the valve assembly in a fully opened position. Operation of the valve assembly 30 will be described. First, the distal end 73 of the valve actuator 63 is pulled upwards to open the valve 42. This may occur either directly by the user or indirectly through a mechanical linkage having one or more members. Upward movement of the valve actuator 63 unseats the actuator head 72 from the valve seat 62 and axially compresses the valve return spring 44. Once the valve 42 is opened, water under pressure located within the water cavity 86 is expelled through the inner passageway 132 and exits the valve assembly water outlet 115. The sudden release of water causes a decrease in pressure within the valve assembly 30 and creates a pressure differential which forces water from the outer passageway 134 through the water passage 78 and into the water cavity 86. While the valve remains open, water entering the water cavity 86 from the outer passageway 134 is purged from the valve assembly 30 through the inner passageway 132. The pressure exerted on the actuator head 72 by the flow of water keeps the valve open without having to maintain the valve actuator 63 in a raised position.

Mechanical movement by the valve actuator 63 does not translate directly into mechanical movement by the piston. Rather, the piston moves in response to a hydrodynamic connection between the valve and the piston due to the fluid communication between the valve and the piston. Before actuation of the valve, the piston remains closed due to the balance of pressures acting upon it. The downward pressure exerted by the water contained in the outer passageway 134 together with the downward pressure of the piston return spring 48 are equal to or greater than the upward pressure exerted by the water contained within the tank cavity 28. Opening of the valve results in an imbalance of the pressures acting upon the piston. In particular, actuation of the valve 42 permits the release of water from the outer passageway 134 which creates a pressure differential across the piston 50. The pressure above the piston decreases until the piston breaks the seal with the discharge port 34. Once the seal is broken, the piston will move axially upwards to permit the flow of pressurized water contained within the tank cavity 28 through the discharge port 34 and into the toilet tank. Thus, piston movement results from a hydrodynamic response to the valve when the valve is opened to allow the release of water contained within the valve assembly.

When the piston moves axially upwards, the connection at its lower end causes corresponding upward movement by the bellows tube and the sleeve. Moreover, upward movement of the piston 50 causes upward axial compression of the piston return spring 48 and the bellows tube 46. As shown in FIG. 4, movement of the piston 50 continues until the sleeve upper end 112 engages the downwardly projecting annular skirt 64. As the piston moves upward, water remaining within the outer passageway 134 is forced into the water cavity 86 and flows through the open valve 42 to exit the valve assembly water outlet 115. Due to the upward force being exerted on the piston 50 as the water exits the discharge port 34, the piston remains open until the pressurized water within the tank 10 is expelled.

FIG. 3 shows the valve assembly in a fully closed position. Closing of the valve 42 occurs when the resulting pressure drop due to the release of water from the housing upper and lower portions allows the valve return spring 44 to move the valve actuator 63 back into a closed position so that the actuator head 72 forms a fluid seal with the valve seat 62. The resulting pressure drop due to the release of water from the tank allows the piston 50 to close once the water is expelled from the tank cavity. The piston return spring 48 allows the piston 50 to move downwardly until it forms a fluid seal with the discharge port 34. Downward movement of the piston 50 will cause corresponding movement of the bellows tube 46 and the sleeve 52. When the piston 50 forms a seal with the discharge port 34, the tank begins to refill and repressurize as water enters through the interior tube 26. Once the water level within the tank cavity 28 reaches the height of the valve assembly water inlet 45, water begins to fill valve assembly 30. The pressure within the valve assembly is equal to the pressure within the tank due to the fluid communication between the valve assembly 30 and the tank 10 at the valve assembly water inlet 45. Water entering the valve assembly 30 fills the outer passageway 134 and assists the piston return spring 48 in biasing the piston 50 against the conical seat of the discharge port so as to keep the piston in a closed position. Continued filling of the outer passageway 134 allows water to enter the water cavity 86 through the water passage 78. Water contained within the water cavity 86 together with the valve return spring 44 assist in biasing the valve 42 to a closed position. Once the tank cavity 28 is fully filled, the pressure flush system is ready for another actuation.

While the preferred form of the invention has been shown and described, it is understood that there may be many modifications, substitutions and alterations thereto without departing from the scope of the claims. For instance, in addition to the bellows tube and sleeve, other types of fluid conduits may be received within the piston axial bore and define an inner passageway which passes through the piston and allows for discharge of water contained within the housing.

What is claimed is:

1. A pressure flush system for use within a toilet tank including:

a pressure flush tank having an inlet port and a discharge port;

an air inlet for said pressure flush tank, with said pressure flush tank, prior to discharge, containing water under pressure;

a valve assembly within said pressure flush tank including a generally cylindrical housing containing water under pressure, a water inlet in fluid communication with said pressure flush tank, a water outlet in fluid communication with said discharge port, a normally closed valve being.movable to allow fluid communication between said water inlet and said water outlet and to permit discharge of water contained within said housing, a piston axially spaced from said valve and in fluid communication therewith, said piston being movable, relative to said valve, into and out of sealing engagement with said discharge port to permit discharge of water under pressure contained within said pressure flush tank, and a flexible tube positioned within said housing carried between said valve and said piston and in fluid communication therebetween and being movable in response to movement of said piston.

2. The pressure flush system of claim 1 wherein said valve assembly defines inner and outer coaxial fluid passageways.

3. The pressure flush system of claim 2 wherein said inner and outer coaxial fluid passageways which are fluidly sealed therebetween by said valve when said valve is closed and in fluid communication therebetween when said valve is opened.

4. The pressure flush system of claim 2 wherein said inner coaxial fluid passageway is in fluid communication with said discharge port.

5. The pressure flush system of claim 2 wherein said outer coaxial fluid passageway is in fluid communication with said pressure flush tank and contains water under pressure therefrom when said valve is closed.

6. The pressure flush system of claim 1 wherein said flexible tube is an axially collapsible bellows tube.

7. The pressure flush system of claim 1 wherein said flexible tube axially retracts in response to upward axial movement of said piston and axially expands in response to downward axial movement of said piston.

8. The pressure flush system of claim 1 further comprising a valve return spring.

9. The pressure flush system of claim 1 further comprising a piston return spring.

10. The pressure flush system of claim 1 further comprising a sleeve which extends internally into said flexible tube.

11. The pressure flush system of claim 10 wherein said sleeve is in fluid communication with said discharge port.

12. The pressure flush system of claim 10 wherein said sleeve is axially spaced from said valve when said piston is in sealing engagement with said discharge port.

13. The pressure flush system of claim 10 wherein said sleeve is positioned axially adjacent said valve when said piston is out of sealing engagement with said discharge port.

14. A pressure flush system for use within a toilet tank including:

a pressure flush tank including an inlet port and a discharge port;

an air inlet for said pressure flush tank, with said pressure flush tank, prior to discharge, containing water under pressure;

a valve assembly within said pressure flush tank including a generally cylindrical housing containing water under pressure, a water inlet in fluid communication with said pressure flush tank, a water outlet in fluid communication with said discharge port, a normally closed valve being movable to allow fluid communication between said water inlet and said water outlet and to permit discharge of water contained within said housing, a piston axially spaced from said valve and in fluid communication therewith, said piston being axially aligned with said discharge port and being movable into and out of sealing engagement therewith to permit discharge of water contained within said pressure flush tank, said piston including an axial bore which receives at least one axially disposed fluid conduit therein such that water contained within said housing is discharged axially through said piston, said fluid conduit being movable in response to movement of said piston.

15. The pressure flush system of claim 14 wherein said fluid conduit is selected one of a flexible tube and a rigid sleeve.

16. The pressure flush system of claim 14 wherein said valve assembly defines inner and outer coaxial fluid passageways.

17. A pressure flush system for use within a toilet tank including:

a pressure flush tank including an inlet port and a discharge port;

an air inlet for said pressure flush tank, with said pressure flush tank, prior to discharge, containing water under pressure;

a valve assembly within said pressure flush tank including a generally cylindrical housing and a normally closed valve, said valve assembly defining inner and outer coaxial fluid passageways which are fluidly sealed therebetween by said valve, said inner coaxial fluid passageway being in fluid communication with said discharge port, said outer coaxial fluid passageway being in fluid communication with said pressure flush tank and containing water under pressure therefrom, said inner and outer coaxial fluid passageways being in fluid communication therebetween upon actuation of said valve to allow discharge of water contained within said outer passageway through said discharge port, a piston axially spaced from said valve and in fluid communication therewith, said piston being axially aligned with said discharge port and being movable into and out of sealing engagement therewith to permit discharge of water contained within said pressure flush tank, said piston including an axial bore, at least a portion of a flexible tube disposed in said axial bore and defining a portion of at least one of said inner and outer coaxial fluid passageways.

18. The pressure flush system of claim 17 wherein said inner coaxial fluid passageway extends through said piston axial bore such that water contained within said housing is discharged axially through said piston.

19. The pressure flush system of claim 17 wherein said outer coaxial fluid passageway is circumferentially disposed around said flexible tube.

20. The pressure flush system of claim 17 further including a movable, rigid sleeve disposed in said axial bore of said piston, said sleeve being movable in response to movement of said piston.

21. The pressure flush system of claim 20 wherein at least one of said flexible tube and said rigid sleeve defines said inner coaxial fluid passageway.

* * * * *